US011815260B2

(12) United States Patent
Vetere

(10) Patent No.: US 11,815,260 B2
(45) Date of Patent: Nov. 14, 2023

(54) COLLAPSIBLE MARSHALLING WAND SYSTEM

(71) Applicant: Andrea Vetere, Beechhurst, NY (US)

(72) Inventor: Andrea Vetere, Beechhurst, NY (US)

( * ) Notice: Subject to any disclaimer, the term of this patent is extended or adjusted under 35 U.S.C. 154(b) by 0 days.

(21) Appl. No.: 17/390,082

(22) Filed: Jul. 30, 2021

(65) Prior Publication Data

US 2023/0033056 A1 Feb. 2, 2023

(51) Int. Cl.

| | |
|---|---|
| ***F21L 4/08*** | (2006.01) |
| ***F21V 23/04*** | (2006.01) |
| ***F21V 7/18*** | (2006.01) |
| *F21W 111/10* | (2006.01) |
| *F21W 111/06* | (2006.01) |

(52) U.S. Cl.

CPC ..... *F21V 7/18* (2013.01); *F21L 4/08* (2013.01); *F21V 23/0428* (2013.01); *F21W 2111/06* (2013.01); *F21W 2111/10* (2013.01)

(58) Field of Classification Search

CPC ..... F21V 1/06; F21V 15/012; F21W 2111/06; F21W 2111/10; F21L 4/00; F21L 4/02; F21L 4/08; G08G 5/06; G08G 5/065; G08B 5/006; A45B 3/02; A45B 3/04

See application file for complete search history.

(56) References Cited

U.S. PATENT DOCUMENTS 3,890,497 A * 6/1975 Rush ..... G02B 6/001 340/432
8,456,329 B1 * 6/2013 Tran ..... G08C 17/02 362/186
2006/0262525 A1 * 11/2006 Barbeau ..... F21V 23/02 362/157
2007/0019398 A1 * 1/2007 Chen ..... F16M 13/04 362/102
2009/0251078 A1 * 10/2009 Oh ..... G08B 5/006 362/183

(Continued)

FOREIGN PATENT DOCUMENTS

WO WO-2013017120 A2 * 2/2013 ..... B60Q 1/52

OTHER PUBLICATIONS

Machine translation of WO 2013/017120 A2, retrieved from worldwide.espacenet.com on Oct. 24, 2022 (Year: 2022).*

(Continued)

*Primary Examiner* — Andrew J Coughlin
*Assistant Examiner* — Steven Y Horikoshi
(74) *Attorney, Agent, or Firm* — The Law Office of Daniel T. Weglarz, P.C.

(57) ABSTRACT

A collapsible marshalling wand system that includes a marshalling wand that can be set in an elongated operational configuration while used, as well as a smaller collapsed configuration when not in use, and an accompanying recharging device, along with an accompanying charging station. The marshalling wand includes a plurality of wand portions integrated telescopically, with the wand portions including a lighting system and a wireless alert system. The charging station allows for multiple marshalling wands to be recharged simultaneously in a variety of locations. As such, the collapsible marshalling wand system allows all ground personnel to conveniently keep a marshalling wand with them at all times as well as for extra marshalling wands to be stored at a charging station positioned on runways.

15 Claims, 2 Drawing Sheets

(56) References Cited

U.S. PATENT DOCUMENTS

2015/0029701 A1* 1/2015 Weidman ..... F21L 4/02
362/102

OTHER PUBLICATIONS

Tow Team Warning System. Datasheet [online]. Airelectric Inc., 2013 [retrieved on Apr. 8, 2019]. Retrieved from be Internet: <URL: www_airelectric_us/ttws>.

* cited by examiner

COLLAPSIBLE MARSHALLING WAND SYSTEM

BACKGROUND OF THE INVENTION

Field of the Invention

This invention relates to a collapsible marshalling wand and accompanying charging station that can recharge a plurality of the collapsible marshalling wands simultaneously.

Description of the Prior Art

Aircraft marshalling is generally understood to be the visual signaling operation between ground personnel and an operator that is moving an aircraft on the ground. One common piece of equipment for ground personnel to use when marshalling an aircraft is a marshalling wand. A marshalling wand is a handheld illuminated beacon that can be used on airport runways by a marshaller or other personnel to signal to the pilot (if the aircraft needs to move forward) or the driver of the tow truck (if the aircraft need to move backwards).

Notwithstanding the presence of aircraft marshallers and other ground personnel, very costly damage to aircraft due to insufficient communication on the runway is not uncommon. Indeed, because typical marshalling wands are cumbersome and have finite power supplies, it is not atypical for ground personnel to be caught on the runway without a marshalling wand when they need one. Thus, there remains a need for a collapsible marshalling wand system that includes a wand that can be set in an operational configuration to be used as a typical marshalling wand as well as a collapsed configuration in which it is easy to carry and store. It would be desirable if such a collapsible marshalling wand system includes a wand that could be used with a charging station that could recharge several collapsible marshalling wands simultaneously. It would be additionally desirable for such a collapsible marshalling wand system to include a wand with a wireless alert system that could be used to direct a sensory alert to a pilot or driver of a tow truck in the event the pilot/driver does not see the marshaller's signal.

SUMMARY OF THE INVENTION

The present disclosure provides for a marshalling wand that can be set in an elongated operational configuration while used, as well as in a smaller collapsed configuration when not in use, and an accompanying recharging device, along with an accompanying charging station. The collapsible marshalling wand comprises a marshalling wand having a plurality of wand portions integrated telescopically so as to be positionable in both an operational configuration and a collapsed configuration, wherein the plurality of wand portions include at least a distal wand portion at a distal end and a proximal wand portion at a proximal end, with the proximal wand portion sized to allow each other wand portion in the plurality of wand portions to be nested therein when the plurality of wand portions are in the collapsed configuration. Further, at least one of the wand portions among the plurality of wand portions includes a lighting system and is configured to selectively illuminate. Moreover, at least one of the wand portions among the plurality of wand portions includes at least one electrical contact which provides a connection interface through which electricity can be directed to the at least one of the wand portions among the plurality of wand portions that includes the lighting system and is configured to selectively illuminate. When in operation, the collapsible marshalling wand allows all ground personnel to conveniently keep a marshalling wand with them at all times as well as for extra marshalling wands to be stored at a charging station positioned on or near airport runways.

It is an object of this invention to provide a collapsible marshalling wand system that includes a wand that can be set in an operational configuration to be used as a typical marshalling wand as well as a collapsed configuration in which it is easy to carry and store.

It is another object of this invention to provide a collapsible marshalling wand system that includes a wand that can be used with a charging station that could charge several collapsible marshalling wands simultaneously.

It is yet another object of this invention to provide a collapsible marshalling wand system that includes a wand that has a wireless alert system that could be used to direct a sensory alert to a pilot or driver of a tow truck in the event the pilot/driver does not see the marshaller's signal.

These and other objects will be apparent to one of skill in the art.

DETAILED DESCRIPTION OF THE INVENTION

Disclosed herein is a marshalling wand and charging station that make marshalling wands more easily accessible and convenient to carry. The marshalling wand of the present invention is collapsible so that it can contract down to a much smaller length for carrying. It also has a D-ring or carabiner attached so that it can easily clip to a belt loop. The marshalling wand may be utilized with a charging station that can hold several marshalling wands simultaneously while charging the internal battery of each of the held marshalling wands.

Figure 1:
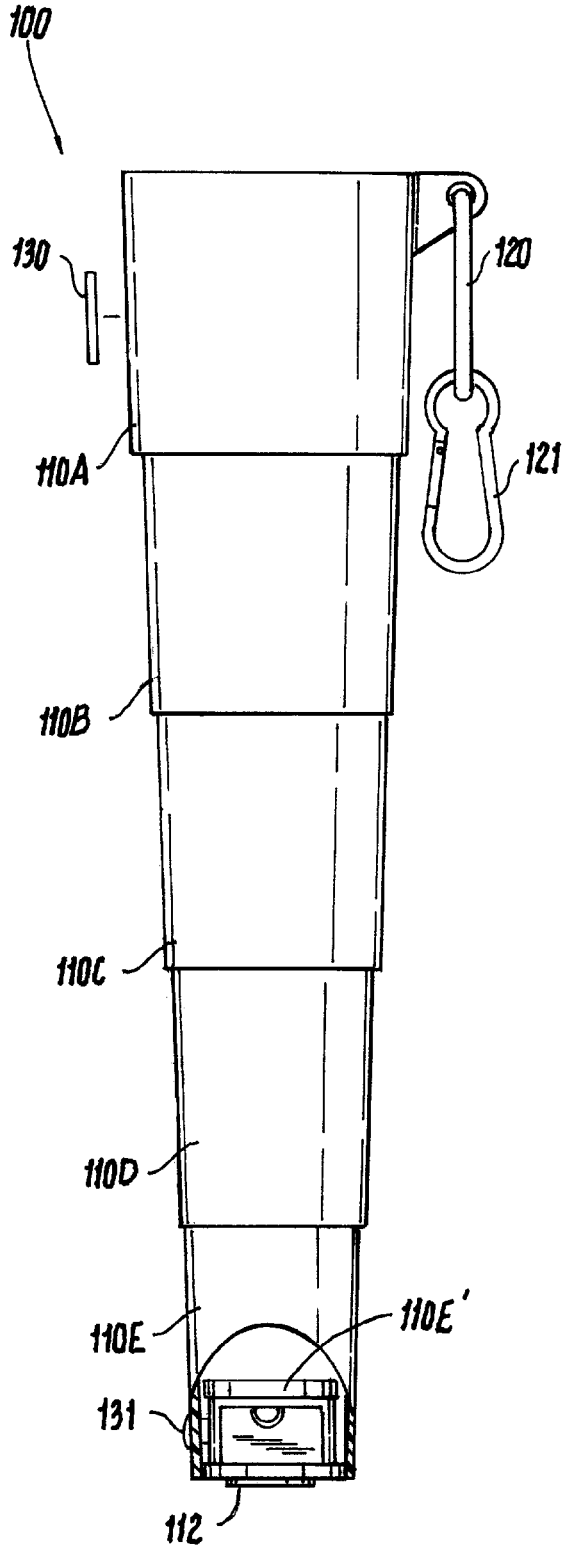
FIG. 1 is a side elevation view of a marshalling wand of a collapsible marshalling wand system built in accordance with the present invention in an operational configuration.
Figure 2:
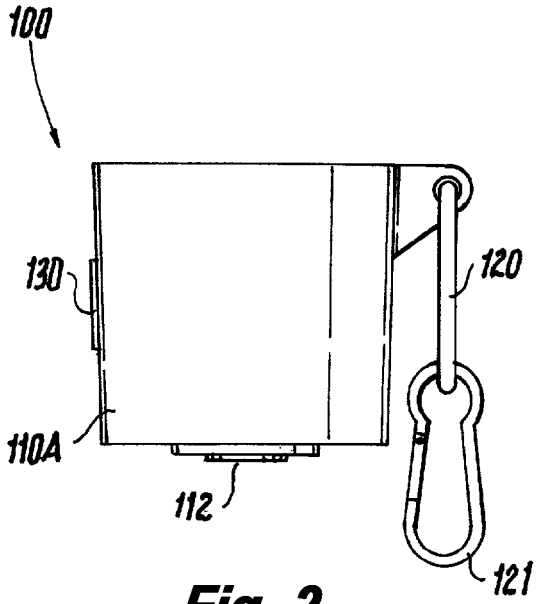
FIG. 2 is a side elevation view of a marshalling wand of a collapsible marshalling wand system built in accordance with the present invention in a collapsed configuration.
Figure 4:
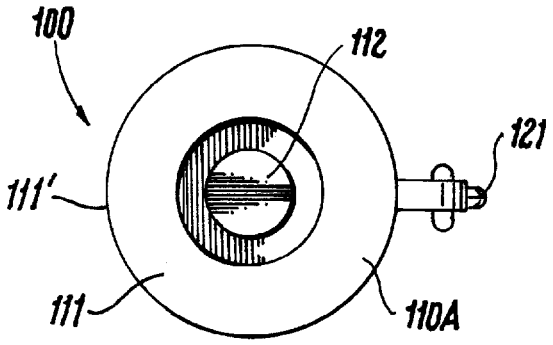
FIG. 4 is a top plan view of a marshalling wand of a collapsible marshalling wand system built in accordance with the present invention.
Figure 3:
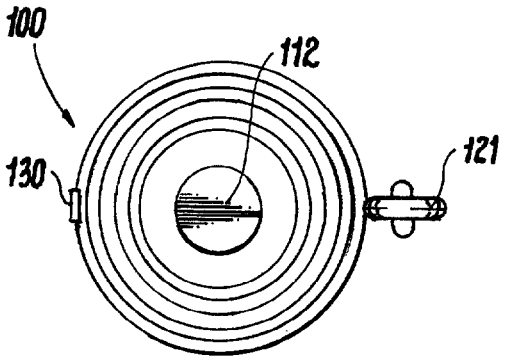
FIG. 3 is a bottom plan view of a marshalling wand of a collapsible marshalling wand system built in accordance with the present invention.

Referring now to the drawings and, in particular, FIGS. 1, 2, 3, and 4, a collapsible marshalling wand 100 is shown having a plurality of wand portions 110A, 110B, 110C, 110D, 110E (collectively 110) integrated telescopically so as to be positionable in both an operational configuration, as illustrated in FIG. 1, and a collapsed configuration, as illustrated in FIG. 2. To be placed in the collapsed configuration, each of the wand portions 110 except the proximal wand portion 110A slides into the next largest wand portion 110 so as to be nested therein, resulting in all of the wand portions 110 except the largest wand portion 110A being contained in the proximal wand portion 110A. To move to the operational configuration, each wand portion 110 slides apart from one another and can be twisted to frictionally engage the wand portions 110 adjacent thereto in order to be secured in place.

The proximal wand portion 110A may include an upper surface 111 that is defined by a rigid lid that includes a centrally located aperture therein. The upper surface 111 may be structured to form a basin at the top of the proximal wand portion 110A with an elevated perimeter rim 111' so as to allow for more secure stacking of multiple collapsible marshalling wands 100 in the manner discussed below. The proximal wand portion 110A may also include an attachment loop 120 that is coupled to an attachment device such as a D ring 121 or carabiner (not shown).

The distal wand portion 110E may be defined by a housing that includes a battery (not shown), a switch (not shown), and an electric light 110E', with the battery, switch, and electric light electrically connected such that the switch can selectively cause electricity stored in the battery to be directed to the electric light in order to cause the electric light to illuminate. In this regard, the battery provides a power source, the switch provides a switching element, and the electric light provides an illumination element, and these elements collectively provide a lighting system that is configured to enable the distal wand portion 110E, and potentially other wand portions 110 as well, to selectively illuminate.

The distal wand portion 110E additionally includes electrical contacts 112 forming its top surface and its bottom surface. These electrical contacts 112 provide a connection interface through which electricity can be directed into the internal battery of the distal wand portion 110E when the collapsible marshalling wand 100 is being recharged, as discussed below. The electrical contact 112 forming the bottom surface may extend downward from the marshalling wand 110, while the electrical contact 112 forming the top surface may be accessible when the marshalling wand 110 is in the collapsed configuration through the centrally located aperture in the upper surface 111 of the proximal wand portion 110A. In this regard, if multiple marshalling wands 100 are stacked, the electrical contact 112 forming the bottom surface of a marshalling wand 110 positioned on top will contact the electrical contact 112 of a marshalling wand positioned on bottom through the centrally located aperture.

One or multiple of the wand portions 110 may include retroreflective strips or devices, or other reflective material, on their outer surface. It is appreciated that this may operate to improve the collapsible marshalling wand's 100 ability to serve as a high visibility object.

The proximal wand portion 110A may include a wireless alert system that may include a detachable communicator 130 and an actuator button 131, each of which may be operatively coupled to a separate power source. The detachable communicator 130 may be attachable to the proximal wand portion 110A through the inclusion of a magnet on either the detachable communicator 130 and the proximal wand portion 110A, and ferromagnetic material on the other. In other embodiments, the detachable communicator 130 may be attachable to the proximal wand portion 110A through the inclusion of other fasteners known in the art, including corresponding portions of hook and loop fastening material on both the detachable communicator 130 and the proximal wand portion 110A.

The detachable communicator 130 and actuator button 131 each include an internal antenna that allows the actuator button 131 to transmit an electrical signal wirelessly to the detachable communicator 130. For example, the detachable communicator 130 and actuator button 131 may each be connected to a wireless local area network so as to allow wireless communication between them. In response to the receipt of an electrical signal from the actuator button 131 generated in response to manual actuation of the actuator button 131, the detachable communicator 130 may emit a sensory alert, such as an audible alarm, visible flashing light, or vibrating alarm so as to provide an additional way of signaling a pilot or tow truck driver in case she does not see a marshaller signaling her. In this regard, it is contemplated that the detachable communicator 130 may be temporarily placed on the dashboard or removably mounted inside an aircraft being marshalled or a tow truck that is moving an aircraft being marshalled. Then, the detachable communicator 130 can be returned to the marshaller and reconnected to the wand for future use when finished.

There may be just one alert signal, such as when the marshaller is telling the driver to emergency stop. Or there can be multiple directions built in, such as stop, go, slow down, go left/right, and so forth. For example, a different sound, different color light or light pattern, or vibration pattern can be used to communicate different directions.

The detachable communicator 130 may alternatively be permanently mounted in the cabin of the tow truck or aircraft and powered through that device.

In an alternate embodiment, a fixed alert system that may include an actuator button 131 may be employed in addition to or in the alternative to the wireless alert system. In the fixed alert system, an electrical signal from the actuator button 131 may cause the collapsible marshalling wand 100 to emit a loud sound, a light, or other sensory alert.

Figure 5:
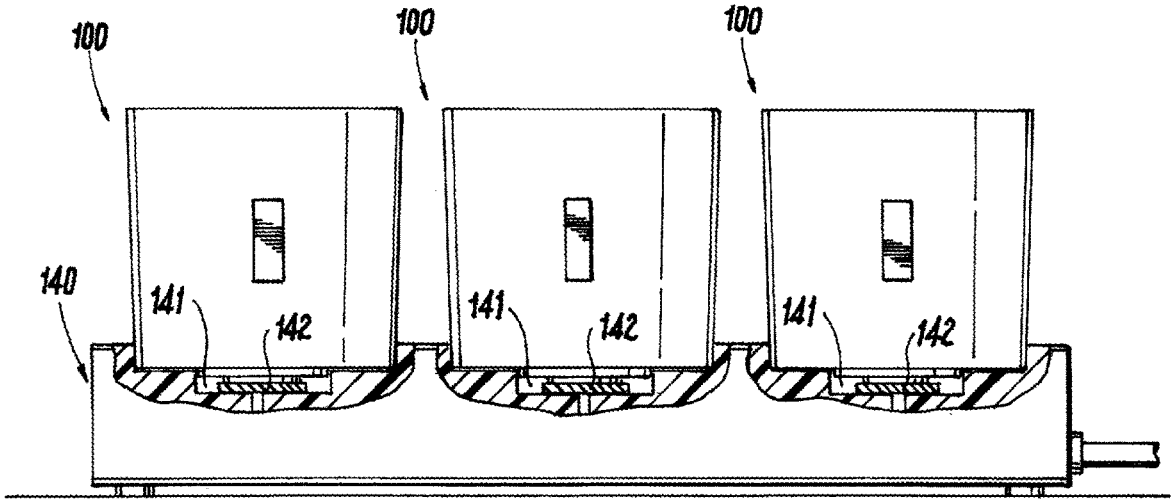
FIG. 5 is a side elevation view of a cross section of a collapsible marshalling wand system built in accordance with the present invention, shown with several collapsible marshalling wands in a collapsed configuration positioned in a general embodiment of a charging station.
Figure 6:
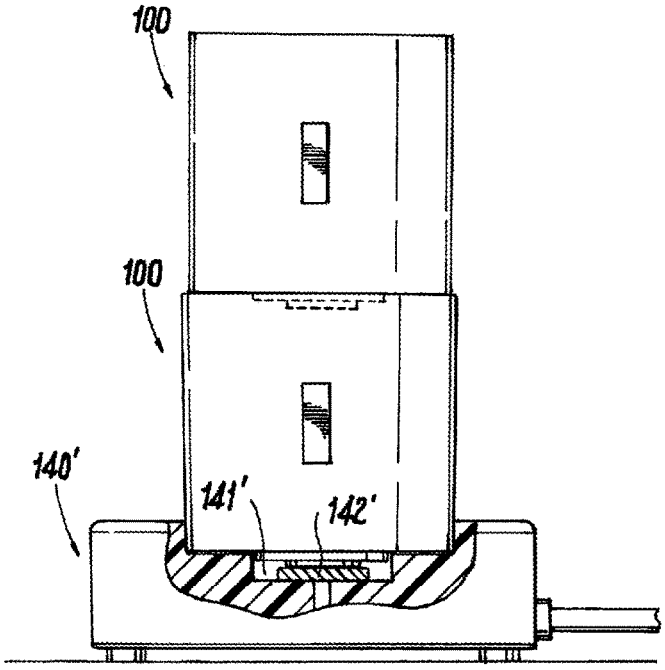
FIG. 6 is a side elevation view of a cross section of a collapsible marshalling wand system built in accordance with the present invention, shown with several collapsible marshalling wands in a collapsed configuration positioned in a stack embodiment of a charging station.

Referring now to FIGS. 5 and 6, as each collapsible marshalling wand 100 uses one or more rechargeable batteries to light up, a charging station 140 is employed to enable multiple collapsible marshalling wands 100 to connect to in order to recharge. In one embodiment, illustrated in FIG. 5, the charging station 140 includes a broad horizontal surface with multiple engaging slots 141, allowing multiple collapsible marshalling wands 100, in their collapsed configuration, to connect to and recharge side by side. In such an embodiment, the electrical contact 112 that forms the bottom surface of the distal wand portion will contact an electrical contact 142 in the engaging slot 141 so as to allow electricity to be directed from the charging station 140 to the battery in the distal wand portion.

In another embodiment, illustrated in FIG. 6, the charging station 140' may include a single engaging slot 141', and with a single collapsible marshalling wand 100, in its collapsed configuration, placed therein with the electrical contact 112 that forms the bottom surface of the distal wand portion contacting an electrical contact 142' in the engaging slot 141'. Additional collapsible marshalling wands 100, in their collapsed configuration, may be stacked on top of the collapsible marshalling wand 100 in the engaging slot 141'. Since the distal wand portion includes electrical contacts 112 as its top and bottom surface and the electrical contact that forms the top surface is adjacent to and exposed through the aperture in the upper surface of the proximal wand portion when the collapsible marshalling wand 100 is in its collapsed configuration, when a collapsible marshalling wand is placed on top of another one, the electrical contact the forms the bottom surface of the distal wand portion for the collapsible marshalling wand on top can contact and receive electricity through the electrical contact that forms the top surface of the distal wand portion of the collapsible marshalling wand underneath.

It is contemplated that when a collapsible marshalling wand is positioned on a charging station, the components of the wireless alert system may be charged through an inductive coupling, with the charging station using an electromagnetic field to transfer energy to the detachable communicator and/or the actuator button through electromagnetic induction.

It is contemplated that the use of such a charging station may provide a convenient supply of charged wands ready for use. A user can simply detach the top wand in the column, carry it around using the attachment mechanism, and extend it into its operational configuration when ready to use.

The charging station may either plug into an electric outlet and/or may be powered by a much longer-lasting rechargeable battery capable of recharging all the wands, so that the charging station can be located out on a runaway if a wired electric power source is not available.

It is to be understood that the invention is not limited in its application to the details of construction and to the arrangements of the elements set forth in the accompanying description or illustrated in the drawings. The invention is capable of other embodiments and of being practiced and carried out in various ways. Also, it is to be understood that the phraseology and terminology employed herein are for the purpose of description and should not be regarded as limiting. The disclosure may readily be utilized as a basis for the designing of other structures, methods, and systems for carrying out the present invention. It is important, therefore, that the claims be regarded as including equivalent constructions. The abstract and the disclosure are neither intended to define the invention, which is measured by the claims, nor are they intended to be limiting as to the scope of the invention in any way.

What is claimed is:

1. A collapsible marshalling wand system, comprising:

a marshalling wand having a plurality of wand portions integrated telescopically so as to be positionable in both an operational configuration and a collapsed configuration, wherein the plurality of wand portions include at least a distal wand portion at a distal end and a proximal wand portion at a proximal end, with the proximal wand portion sized to allow each other wand portion in the plurality of wand portions to be nested therein when the plurality of wand portions are in the collapsed configuration;

wherein at least one of the wand portions among the plurality of wand portions includes a lighting system and is configured to selectively illuminate;

wherein at least one of the wand portions among the plurality of wand portions includes at least one electrical contact that provides a connection interface through which electricity can be directed to the at least one of the wand portions among the plurality of wand portions that includes the lighting system and is configured to selectively illuminate;

wherein at least one of the wand portions among the plurality of wand portions includes a wireless alert system operative to emit a sensory alert integrated therewith; and wherein the wireless alert system includes at least a detachable communicator and an actuator button and said actuator button is configured to cause an electrical signal to be transmitted to the detachable communicator wirelessly.

2. The collapsible marshalling wand system of claim 1, wherein the proximal wand portion is the at least one of the wand portions among the plurality of wand portions that includes the wireless alert system.

3. The collapsible marshalling wand system of claim 1, wherein the distal wand portion is the at least one of the wand portions among the plurality of wand portions that includes said at least one electrical contact.

4. The collapsible marshalling wand system of claim 3, wherein the distal wand portion is the at least one of the wand portions among the plurality of wand portions that includes the lighting system and is configured to selectively illuminate.

5. The collapsible marshalling wand system of claim 1, wherein the distal wand portion is the at least one of the wand portions among the plurality of wand portions that includes the lighting system and is configured to selectively illuminate.

6. The collapsible marshalling wand system of claim 1, additionally comprising a charging station operative to hold and to supply electrical power to the marshalling wand.

7. The collapsible marshalling wand system of claim 1, wherein the proximal wand portion includes an attachment loop.

8. A collapsible marshalling wand system, comprising:

a marshalling wand having a plurality of wand portions integrated telescopically so as to be positionable in both an operational configuration and a collapsed configuration, wherein the plurality of wand portions include at least a distal wand portion at a distal end and a proximal wand portion at a proximal end, with the proximal wand portion sized to allow each other wand portion in the plurality of wand portions to be nested therein when the plurality of wand portions are in the collapsed configuration;

wherein the distal wand portion includes a lighting system and is configured to selectively illuminate;

wherein the distal wand portion includes at least one electrical contact that provides a connection interface through which electricity can be directed to the lighting system;

a charging station operative to hold and to supply electrical power to the marshalling wand through a connection to the at least one electrical contact;

wherein at least one of the wand portions among the plurality of wand portions includes a wireless alert system operative to emit a sensory alert integrated therewith; and wherein the wireless alert system includes at least a detachable communicator and an actuator button and said actuator button is configured to cause an electrical signal to be transmitted to the detachable communicator wirelessly.

9. The collapsible marshalling wand system of claim 8, wherein the proximal wand portion is the at least one of the wand portions among the plurality of wand portions that includes the wireless alert system.

10. The collapsible marshalling wand system of claim 8, wherein the proximal wand portion includes an attachment loop.

11. A collapsible marshalling wand system, comprising:

a marshalling wand having a plurality of wand portions integrated telescopically so as to be positionable in both an operational configuration and a collapsed configuration, wherein the plurality of wand portions include at least a distal wand portion at a distal end and a proximal wand portion at a proximal end, with the proximal wand portion sized to allow each other wand portion in the plurality of wand portions to be nested therein when the plurality of wand portions are in the collapsed configuration;

wherein the proximal wand portion includes an upper surface that includes a centrally located aperture;

wherein the distal wand portion includes a lighting system and is configured to selectively illuminate; and wherein the distal wand portion includes a plurality of electrical contacts that each provide a connection interface through which electricity can be directed, with at least one of the electrical contacts being accessible through the centrally located aperture in the upper surface of the proximal wand portion when the marshalling wand is in the collapsed configuration.

12. The collapsible marshalling wand system of claim 11, wherein the proximal wand portion includes a wireless alert system operative to emit a sensory alert.

13. The collapsible marshalling wand system of claim 12, wherein the wireless alert system includes at least a detachable communicator and actuator button and said actuator button is configured to cause an electrical signal to be transmitted to the detachable communicator wirelessly.

14. The collapsible marshalling wand system of claim 11, additionally comprising a charging station operative to hold and to supply electrical power to the marshalling wand through a connection to the at least one electrical contact.

15. The collapsible marshalling wand system of claim 11, wherein the proximal wand portion includes an attachment loop.

* * * * *